US005487274A

United States Patent [19]

Gulati et al.

[11] Patent Number: 5,487,274

[45] Date of Patent: Jan. 30, 1996

[54] SCREECH SUPPRESSOR FOR ADVANCED LOW EMISSIONS GAS TURBINE COMBUSTOR

[75] Inventors: Anil Gulati, Albany; Richard E. Warren, Jr., Schenectady; Eayre B. Voorhees, Sloansville, all of N.Y.

[73] Assignee: General Electric Company, Schenectady, N.Y.

[21] Appl. No.: 225,489

[22] Filed: Apr. 8, 1994

Related U.S. Application Data

[63] Continuation of Ser. No. 555,583, May 3, 1993, abandoned.

[51] Int. Cl.[6] ..... F02C 7/24

[52] U.S. Cl. ..... 60/725; 60/737

[58] Field of Search ..... 60/725, 737, 738, 60/748, 261, 749; 181/213; 431/114, 350

[56] References Cited

U.S. PATENT DOCUMENTS

| | | | |
|---|---|---|---|
| 3,601,985 | 8/1971 | Bauger | 431/114 |
| 3,944,142 | 3/1976 | Welden et al. | 239/552 |
| 4,180,972 | 1/1980 | Herman et al. | 60/39.32 |
| 4,397,631 | 8/1983 | Fisher | 431/114 |
| 4,589,260 | 5/1986 | Krockow | 60/748 |
| 5,129,226 | 7/1992 | Bigelow et al. | 60/749 |
| 5,218,824 | 6/1993 | Cederwall et al. | 60/737 |
| 5,267,851 | 12/1993 | Washam et al. | 60/749 |

*Primary Examiner*—Timothy S. Thorpe
*Attorney, Agent, or Firm*—Paul R. Webb, II

[57] ABSTRACT

Combustion-induced unsteady oscillations referred to as screech are suppressed in gas turbine combustors by a plurality (preferably two to six) of screech suppression members disposed in the premixers of the combustors. The screech suppression members are attached to the centerbody of the premixer and extend radially outward, nearly into contact with the inner surface of the premixer tube. The screech suppression members are uniformly spaced about the centerbody and are axially positioned at or near the end of the centerbody which is closest to the main combustion chamber. Alternatively, each screech suppression member can be attached to the inner surface of the premixer tube and extend radially inward nearly into contact with the centerbody. Possible shapes of the screech suppression members include a thick block, a thin rectangular plate, a triangular plate, a V-shaped member, and a cylindrical bar.

14 Claims, 4 Drawing Sheets

SCREECH SUPPRESSOR FOR ADVANCED LOW EMISSIONS GAS TURBINE COMBUSTOR

This application is a Continuation of application Ser. No. 08/055,583 filed May 3, 1993, now abandoned.

BACKGROUND OF THE INVENTION

This invention relates generally to dry low $NO_x$ gas turbine combustors and more particularly concerns an apparatus for reducing unsteady high frequency transverse oscillations in such combustors.

In power plant design, reducing emissions of harmful gases such as $NO_x$ into the atmosphere is of prime concern. Lean premixed combustion is one approach to lowering $NO_x$ emissions. In lean premixed combustion, fuel and air are premixed in a premixer section prior to combustion in the main combustion chamber. Due to the lean stoichiometry, lean premixed combustion achieves lower flame temperatures and thus produces lower $NO_x$ emissions. However, most advanced premixed combustor designs are susceptible to large unsteady pressure oscillations termed screech because of the turbulent nature of the combustion process and the large volumetric energy release within the closed cavities of the combustor. If not suppressed, screech will severely limit the operation of the device and in some cases can even cause physical disintegration of combustor hardware. Acoustic, energy-absorbing liners are conventionally used to suppress screech. However, these liners are costly and allow air leakage which may have an adverse impact on combustor performance and emission levels.

Accordingly, there is a need for a means to suppress the combustion-induced unsteady pressure oscillations in lean premixed gas turbine combustors without adversely affecting the emissions quality or the operation. There is an additional need for a means to suppress screech which requires only a minimal change in hardware.

SUMMARY OF THE INVENTION

The above-mentioned needs are met by the present invention which provides a gas turbine combustor having a main combustion chamber and a plurality of premixer tubes attached to the main combustion chamber. Each one of the premixer tubes has a centerbody disposed therein. A plurality (preferably two to six) of screech suppression members is disposed in each one of the plurality of the premixer tubes. Each screech suppression member is attached to the centerbody in its respective premixer tube near the end of the centerbody which is closest to the main combustion chamber. Each screech suppression member extends radially outward from its respective centerbody, nearly into contact with an inner surface of its respective premixer tube. Alternatively, each screech suppression member can be attached to an inner surface of its respective premixer tube near the main combustion chamber and extend radially inward nearly into contact with the centerbody of its respective premixer tube.

The screech suppression members may be a rectangular block approximately 1.5 inches long and 0.5 inches thick, a thin rectangular plate about 3 inches long, a thin triangular plate, a V-shaped member, or a cylindrical bar.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
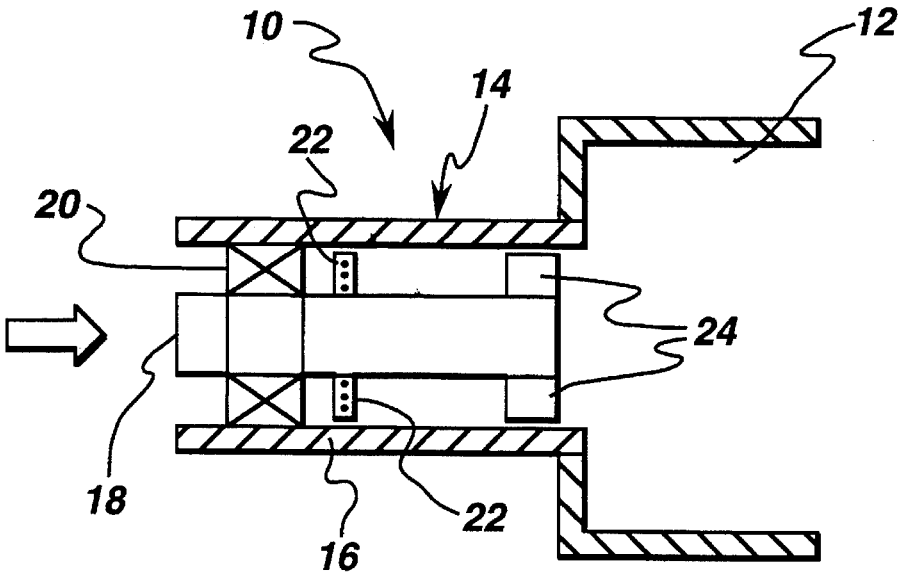
FIG. 1 shows a cross-sectional view of a first embodiment of the present invention.

Referring to the drawings wherein identical reference numerals denote the same elements throughout the various views, FIG. 1 shows a gas turbine combustor 10 of the present invention which is adapted for lean premixed combustion. The combustor 10 includes a main combustion chamber 12 where combustion occurs and at least one premixer section 14 attached to the upstream end of the main combustion chamber 12. The premixer section 14 is arranged to introduce a mixture of fuel and air into the main combustion chamber 12. While only one premixer section is shown in FIG. 1 for clarity of illustration, it should be noted that a plurality of such premixer sections can be used. Five or six of these premixer sections are generally preferred.

The premixer section 14 preferably comprises a cylindrical tube 16 having a cylindrical centerbody 18 disposed concentrically therein. The centerbody 18 is recessed into the premixer tube 16 with respect to the main combustion chamber 12 by approximately two inches. A swirler 20 for producing a swirling pattern to the air flow and fuel-spokes 22 for injecting fuel into the air flow are mounted on the centerbody 18. The swirler 20 and the fuel spokes 22 are disposed sufficiently upstream from the premixer tube exit to allow the fuel and air to premix completely prior to combustion. Thus, as shown by the arrow in FIG. 1, compressed air enters the premixer section 14 from the left and flows to the right. As air flows through the premixer tube 16, it is swirled by the swirler 20. The swirling air passes over the fuel spokes 22 and mixes with the fuel released by the fuel spokes 22. The fuel-air mixture enters the main combustion chamber 12 where it combines with fuel-air mixtures from any other premixer sections which may be joined to the main combustion chamber 12.

Located downstream of the swirler 20 and the fuel spokes 22 is a plurality of screech suppression members 24. The screech suppression members 24 are rectangular-shaped members attached at one edge to the outer cylindrical surface of the centerbody 18 and extending radially outward toward the inner surface of the premixer tube 16. The screech suppression members 24 preferably span almost the entire distance between the centerbody 18 and the premixer tube 16 so as to come nearly into contact with the inner surface of the premixer tube 16. The resulting small gap between the screech suppression members 24 and the premixer tube 16 allows for thermal expansion. The screech suppression members 24 are axially positioned at or near the end of the centerbody 18 closest to the main combustion chamber 12 and are uniformly spaced about the circumference of the centerbody 18. It is believed that the screech suppression members 24 suppress screech by altering the swirl pattern, redistributing the flame stabilization axially (i.e., moving the flame further into the premixing tube 16), and possibly sufficiently altering the lip velocity profile at the centerbody 18 to change the vortex shedding pattern there.

Figure 2:
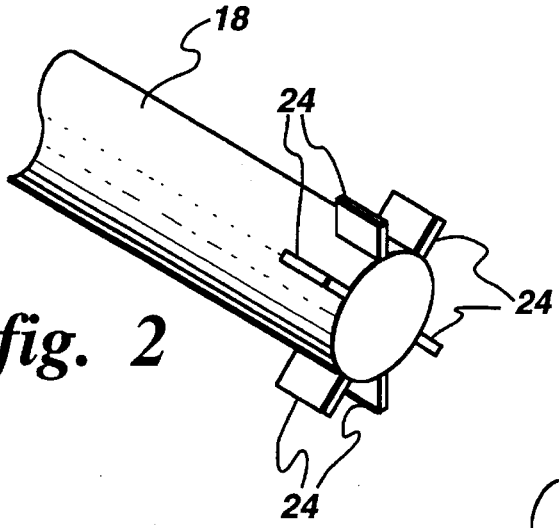
FIG. 2 shows an isometric view of a first configuration of the screech suppression members of the present invention.
Figure 3:
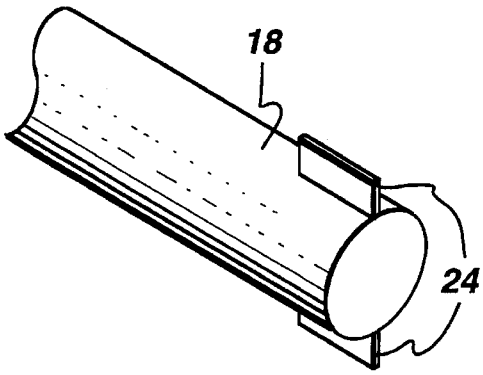
FIG. 3 shows an isometric view of a second configuration of the screech suppression members.

At least two and as many as six screech suppression members 24 can be employed in the present invention. More than six screech suppression members 24 are possible but would be likely to create a detrimental flow blockage. The optimum number, as well as size and shape, of the screech suppression members 24 for best suppressing screech will ultimately depend on the operating conditions of the particular combustor they are being used in. It has been found that when using a larger number such as six of the screech suppression members 24, short, thick blocks provide the best suppression and when using fewer screech suppression members 24, long, thin plates are best. FIG. 2 shows one embodiment where the screech suppression members 24 comprise six blocks uniformly spaced about the centerbody 18. The blocks are preferably about 1.5 inches long and 0.5 inches thick. As mentioned above, the width is preferably dictated by the span of the annulus defined by the centerbody 18 and the premixer tube 16. FIG. 3 shows another embodiment wherein the screech suppression members 24 are a pair of diametrically opposed thin rectangular plates. The plates are substantially thinner than the blocks of FIG. 2 and preferably have an axial length of approximately 3 inches.

Figure 4:
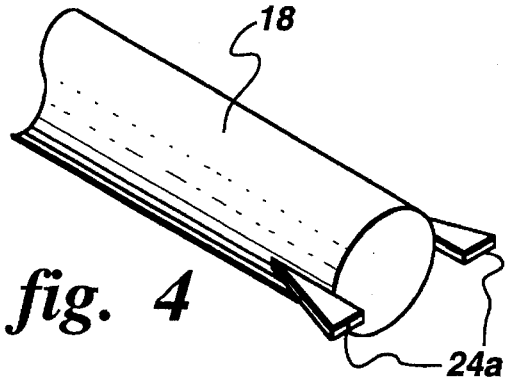
FIG. 4 shows an isometric view of a third configuration of the screech suppression members.
Figure 5:
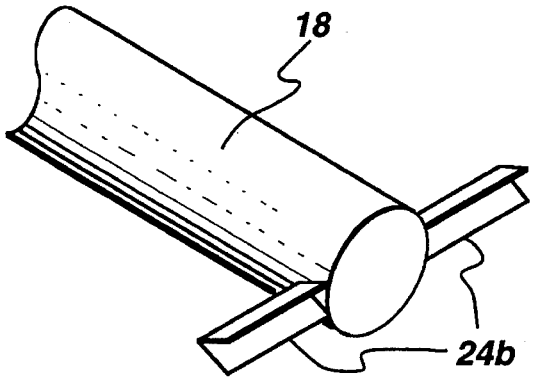
FIG. 5 shows an isometric view of a fourth configuration of the screech suppression members.
Figure 6:
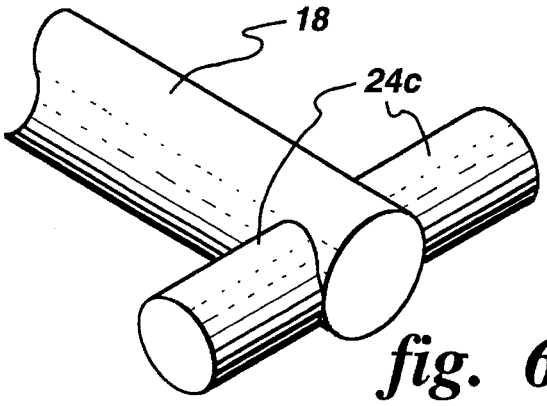
FIG. 6 shows an isometric view of a fifth configuration of the screech suppression members.

FIGS. 4–6 show some alternative configurations of the screech suppression members. FIG. 4 shows two triangular-shaped plates **24*a* having one edge attached to the centerbody 18 and another edge extending radially outward. The triangular plates 24*a* are axially located at the downstream end of the centerbody 18 and extend axially beyond the end to be flush with the premixer tube exit (not shown in FIG. 4). FIG. 5 shows two elongated members 24*b* having a V-shaped cross-section attached to the downstream end of the centerbody 18. The V-shaped members 24*b* extend radially outward from the centerbody 18. FIG. 6 shows two cylindrical bars 24*c* attached to the downstream end of the centerbody 18 and extending radially outward therefrom. As with the rectangular members of FIGS. 1–3, the screech suppression members of FIGS. 4–6 are uniformly spaced about the centerbody 18 and preferably span nearly the entire distance between the centerbody 18 and the inner surface of the premixer tube 16. Also, although only two members are shown in each of FIGS. 4–6, more than two of the alternative screech suppression members can be used in a single premixer tube. The present invention is not limited to the screech suppression member configurations described above; many other configurations are possible. However, the screech suppression members 24 may not introduce more than a minimal pressure drop so as to suppress screech without hampering the operational performance of the combustor 10**.

Figure 7:
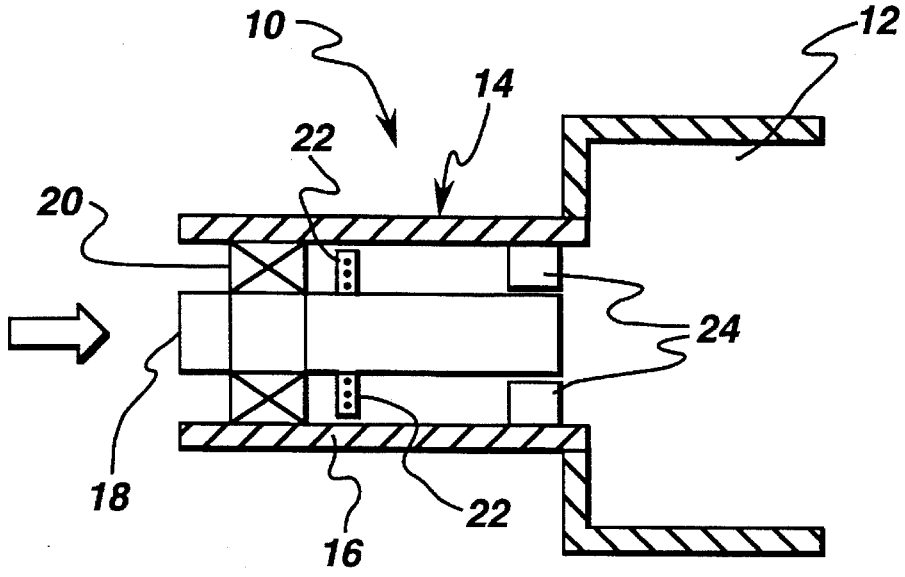
FIG. 7 shows a cross-sectional view of a second embodiment of the present invention.

FIG. 7 shows an alternative embodiment of the present invention. Like the first embodiment, FIG. 7 shows a gas turbine combustor 10' adapted for lean premixed combustion which includes a main combustion chamber 12 and at least one premixer section 14 attached to the upstream end of the main combustion chamber 12 for introducing premixed fuel and air into the main combustion chamber 12. As before, the premixer section 14 preferably comprises a cylindrical tube 16 having a cylindrical centerbody 18 disposed concentrically therein. A swirler 20 and fuel-spokes 22 are mounted towards the upstream end of the centerbody 18. A plurality of screech suppression members 24' are located downstream of the swirler 20 and the fuel spokes 22. The embodiment of FIG. 7 differs from the prior embodiment in that the screech suppression members 24' are attached to the inner surface of the premixer tube 16 and extend radially inward toward the centerbody 18. The screech suppression members 24' preferably span almost the entire distance between the centerbody 18 and the premixer tube 16 so as to come nearly into contact with the centerbody 18. This leaves a small gap between the screech suppression members 24' and the centerbody 18 to allow for thermal expansion. The screech suppression members 24' are positioned on the premixer tube 16 so to be axially aligned with the end of the centerbody 18 which is closest to the main combustion chamber 12. The screech suppression members 24' of FIG. 7 are otherwise the same as the screech suppression members 24 of the first embodiment in that they can be of any number, shape or size as described above.

Figure 8:
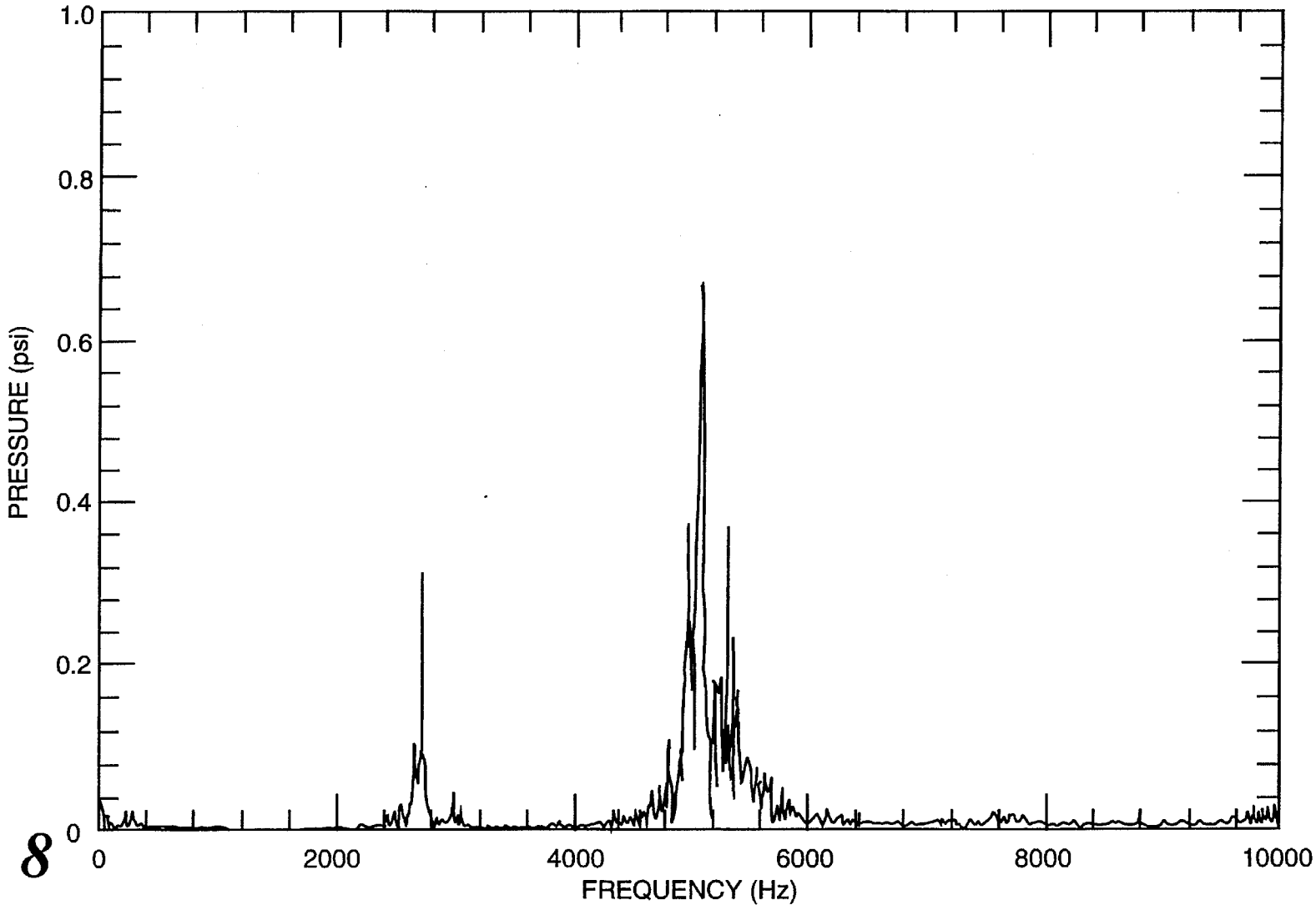
FIG. 8 is a graph showing the level of screech from an experimental device without screech suppression members.
Figure 9:
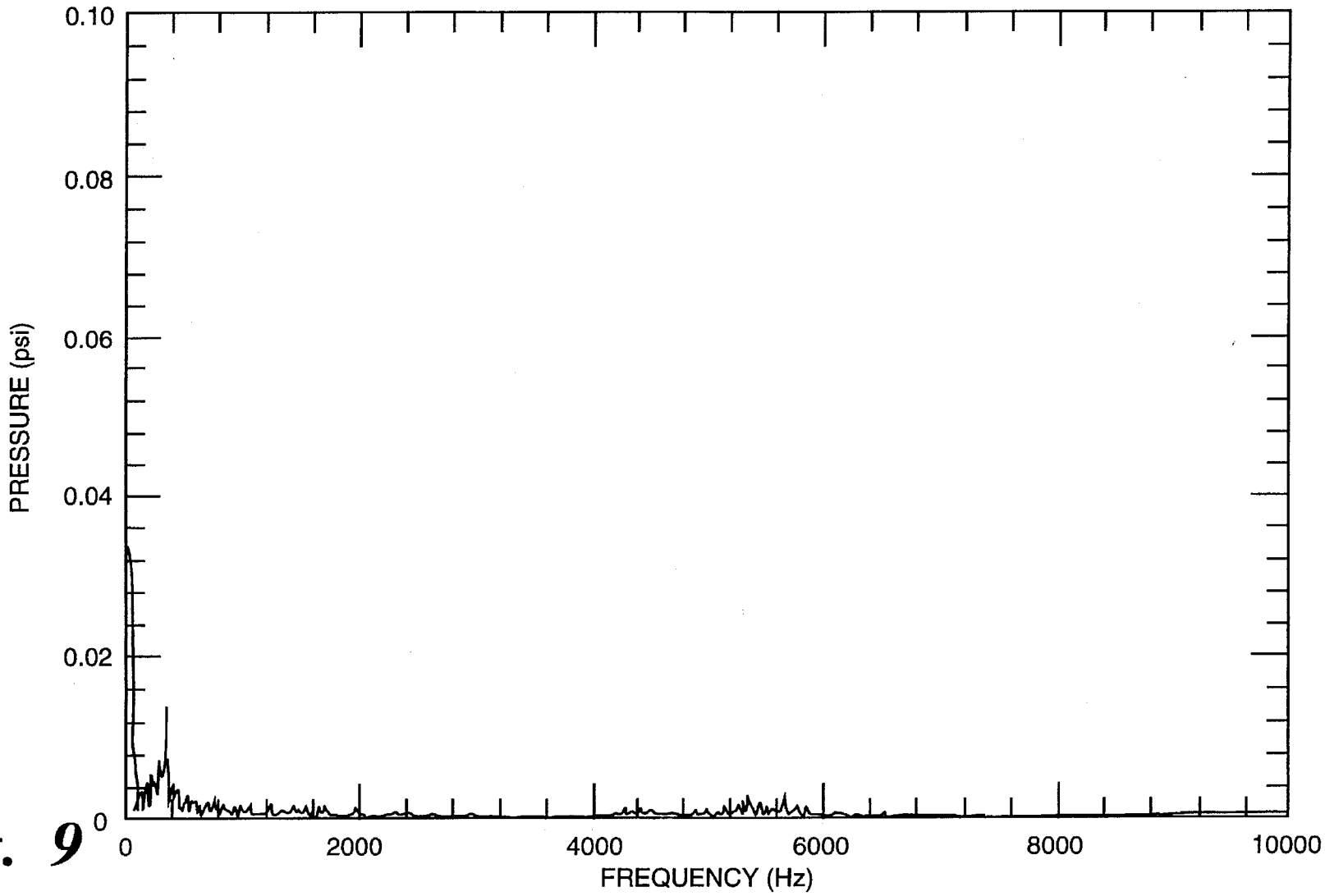
FIG. 9 is a graph showing the level of screech from an experimental device with screech suppression members of the present invention.

The present invention was tested in a lab-scale combustor simulator. The experimental device was comprised of two premixer tubes installed in an 6"×12" duct. The premixer tubes both had a diameter of four inches and were both provided with a two-inch centerbody and a swirler. Tests with and without screech suppression members were performed. The tests were conducted at atmospheric pressure with no preheat. Natural gas was used as the fuel which was completely mixed with air in an upstream plenum chamber. The cold flow velocity in the annulus region of the premixers was 180 feet per second. Without screech suppression members the device screeched strongly in a range of equivalence ratios of 0.57 to 0.65 (strong longitudinal mode oscillations prevented operation at equivalence ratios above 0.65). FIG. 8 shows the typical power spectrum measured at these conditions. With two screech suppression members of the type shown in FIG. 3 attached to the centerbody of each premixer, the device exhibited no screech at equivalence ratios as high as 0.78. FIG. 9 shows the power spectrum obtained at these operating conditions when the screech suppression members were installed (note the change in scale from FIG. 8). At equivalence ratios greater than 0.78, slight screech was produced. However, equivalence ratios above 0.78 are much higher than that planned for lean premixed combustion.

The foregoing has described means for suppressing screech in dry low $NO_x$ gas turbine combustors which do not hinder the performance of the combustor or affect the low emissions level. While specific embodiments of the present invention have been described, it will be apparent to those skilled in the art that various modifications thereto can be made without departing from the spirit and scope of the invention as defined in the appended claims.

What is claimed is:

1. A combustor comprising:

a main combustion chamber;

at least one premixer section attached to said main combustion chamber, said .premixer section including:

a cylindrical premixer tube joined in flow communication with said chamber;

a cylindrical centerbody disposed concentrically in said tube to define an annular flow channel therebetween having an inlet at one end and an exit at an opposite end thereof adjoining said chamber;

a swirler disposed in said channel inlet for receiving and swirling compressed air; and fuel spokes disposed in said channel and downstream of said swirler for injecting fuel into said swirled air to form a fuel and air premix flowable through said channel to said exit and into said chamber; and means for suppressing screech disposed in said premixer section, said means for suppressing screech comprising a plurality of separate, solid body screech suppression members, said screech suppression members being uniformly circumferentially spaced apart from each other at said channel exit, and extending radially between said centerbody and said tube for substantially an entire radial distance therebetween except for a gap formed at one radial end of each of said members for accommodating thermal expansion.

2. The combustor of claim 1 wherein each one of said plurality of screech suppression members is attached to said centerbody.

3. The combustor of claim 1 wherein said centerbody includes an imperforate, bluff aft end recessed axially into said tube relative to said chamber at said channel exit, and each one of said plurality of screech suppression members extends radially outward from said centerbody at said aft end thereof.

4. The combustor of claim 2 wherein each one of said plurality of screech suppression members extends nearly into contact with an inner surface of said tube, and said gap is formed between said inner surface and a radially outer end of each one of said screech suppression members.

5. The combustor of claim 1 wherein each one of said plurality of screech suppression members is attached to an inner surface of said tube.

6. The combustor of claim 5 wherein each one of said plurality of screech suppression members extends radially inward from said inner surface of said tube.

7. The combustor of claim 6 wherein each one of said plurality of screech suppression members extends nearly into contact with said centerbody, whereby said gap is formed between said centerbody and a radially inner end of each one of said screech suppression members.

8. The combustor of claim 1 wherein each one of said plurality of screech suppression members is a rectangular block aligned coaxially with said centerbody to reduce flow blockage.

9. The combustor of claim 8 wherein each one of said rectangular blocks is longer than thick.

10. The combustor of claim 1 wherein each one of said plurality of screech suppression members is a thin rectangular plate aligned axially with said centerbody to reduce flow blockage.

11. The combustor of claim 10 comprising only a pair of said thin rectangular plates disposed diametrically opposite to each other.

12. The combustor of claim 1 wherein each one of said plurality of screech suppression members is a triangular plate aligned coaxially with said centerbody and increasing in radial height in a downstream direction.

13. The combustor of claim 1 wherein each one of said plurality of screech suppression members is a V-shaped member.

14. The combustor of claim 1 wherein each one of said plurality of screech suppression members is a cylindrical bar.

* * * * *